US007958659B1

(12) United States Patent
Tedesco

(10) Patent No.: US 7,958,659 B1
(45) Date of Patent: Jun. 14, 2011

(54) METHOD AND DEVICE OF IDENTIFYING, HOLDING, AND SECURING BUTTONS IN A CORRECT LOCATION ON A GARMENT TO BE REPAIRED

(76) Inventor: Robert W. Tedesco, Winchester, MA (US)

( * ) Notice: Subject to any disclaimer, the term of this patent is extended or adjusted under 35 U.S.C. 154(b) by 847 days.

(21) Appl. No.: 11/776,830

(22) Filed: Jul. 12, 2007

(51) Int. Cl.
*G09F 3/18* (2006.01)

(52) U.S. Cl. ..... 40/661.04; 40/315; 206/296; 206/348

(58) Field of Classification Search ..... 206/294, 206/296, 336, 348; 2/265, 266; 24/3.1, 90.5, 24/92, 3.7, 3.13, 113 R, 113 MP; 224/182; 8/142; 40/315, 661.04
See application file for complete search history.

(56) References Cited

U.S. PATENT DOCUMENTS

| | | | | | |
|---|---|---|---|---|---|
| 804,545 | A | * | 11/1905 | Paine | 206/37.1 |
| 2,099,029 | A | * | 11/1937 | McKay | 229/74 |
| 2,767,902 | A | * | 10/1956 | Hiersteiner | 229/74 |
| 2,920,670 | A | | 1/1960 | Mohlmann | |
| 3,584,349 | A | * | 6/1971 | Shubart | 24/113 MP |
| 3,757,936 | A | * | 9/1973 | Lindegren | 206/527 |
| 4,228,834 | A | | 10/1980 | Desnick | |
| 4,418,733 | A | | 12/1983 | Kallman | |
| 4,789,262 | A | | 12/1988 | Sanchez | |
| 4,918,791 | A | | 4/1990 | Hardin | |
| 5,667,877 | A | * | 9/1997 | Tajiri et al. | 428/195.1 |
| 5,938,025 | A | * | 8/1999 | Chernack | 206/348 |
| 6,131,200 | A | * | 10/2000 | McNamara | 2/144 |
| 6,434,802 | B1 | * | 8/2002 | Pannone | 24/306 |
| 7,073,548 | B1 | | 7/2006 | Berse-Hurley | |
| 7,203,999 | B2 | | 4/2007 | Bagot | |
| 2006/0261160 | A1 | * | 11/2006 | Garner | 235/383 |

* cited by examiner

*Primary Examiner* — J. Gregory Pickett
(74) *Attorney, Agent, or Firm* — O'Connell Law Firm

(57) ABSTRACT

The invention includes a bag or receptacle for securely containing stray buttons and for attaching to a garment at a location of repair to identify where a button is to be reattached or replaced. In one embodiment, such a button bag is sized and shaped like a business card for displaying a business name of a dry cleaner, launderer, tailor, hotel, or other service provider. The receptacle can include a strap for attaching to an existing button, or for looping through a buttonhole corresponding to a location where a button needs to be repaired. The invention provides a solution to button repair identification that is especially useful with express laundry and dry cleaning services and that does not require a user to verbally explain where buttons need to be repaired.

9 Claims, 4 Drawing Sheets

FIG. 3
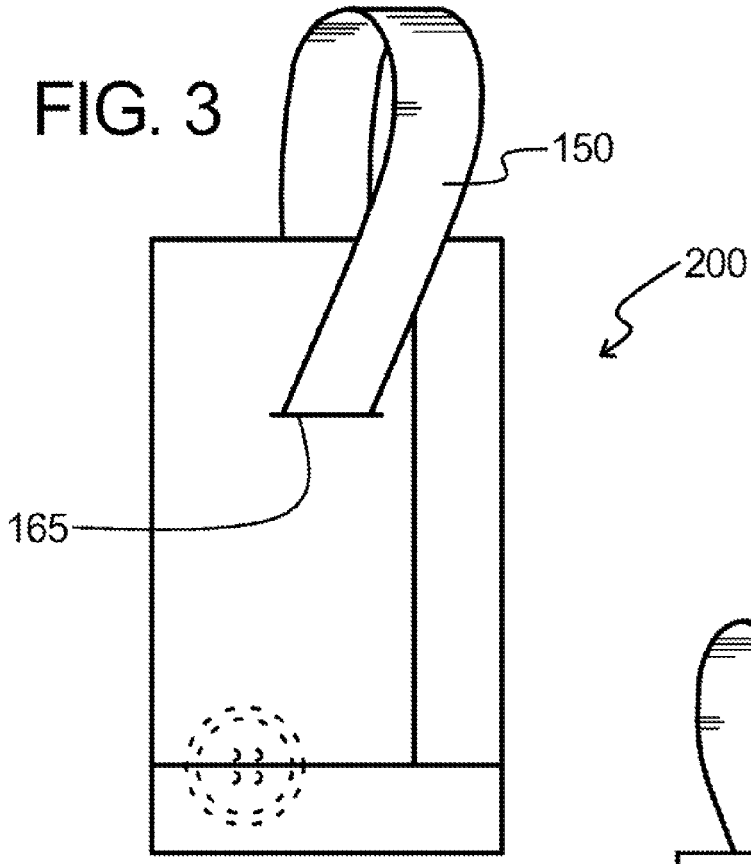
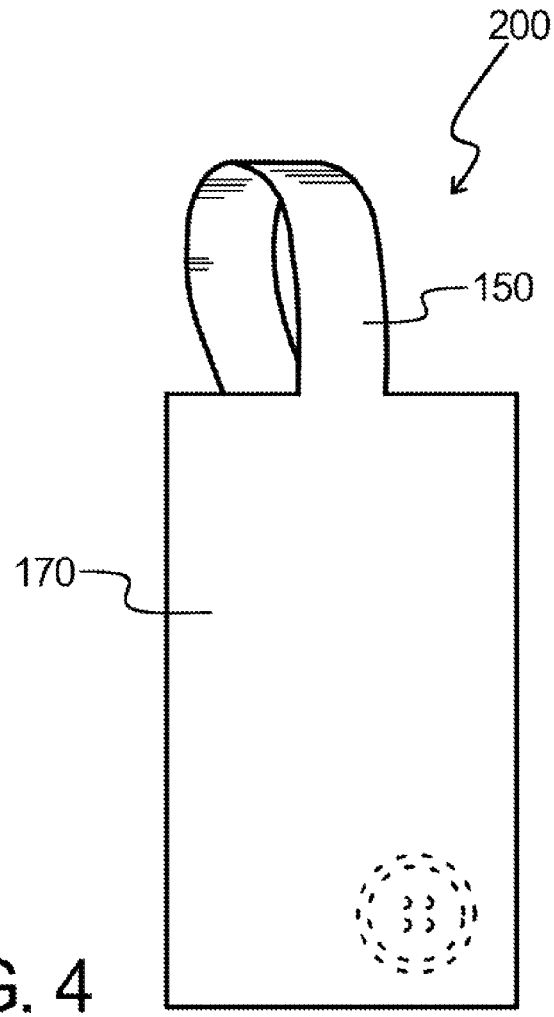
FIG. 4

METHOD AND DEVICE OF IDENTIFYING, HOLDING, AND SECURING BUTTONS IN A CORRECT LOCATION ON A GARMENT TO BE REPAIRED

CROSS-REFERENCE TO RELATED APPLICATIONS

None.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. Copyright 2007 Robert W. Tedesco.

BACKGROUND OF THE INVENTION

1. Field of the Invention

The present invention relates to buttons used on garments, and in particular to button repair in the dry cleaning, laundry, tailoring, and hospitality industries.

2. Background

It is a common problem for buttons to fall from a jacket, blouse, or shirt. Buttons are lost, damaged, or broken as a result of every day wear and tear. Buttons are also lost or weakened in the dry cleaning process due to chemical solvents and physical impact as garments tumble in cleaning tanks.

It is common for people to misplace buttons before being able to take a garment to a dry cleaner or to a tailor for repair. Another common problem arises after bringing a detached button to a dry cleaner. The dry cleaner either misplaces the button before the button gets sewn back on the garment, or employees at the dry cleaner misunderstand where the button was supposed to be sewn onto the garment. This problem is exacerbated when a customer and a dry cleaning employee do not speak the same native language, or when the customer is using express drop off at a dry cleaner or launderer, or when the customer is using a hotel laundry/dry cleaning service, and will not have face-to-face contact with an employee to explain the location of the needed button repair.

There exist button guards or covers that can be manually positioned on all buttons of a garment as a preventative measure before dry cleaning. Yet, manually covering every button on every garment before cleaning becomes time consuming and increases over-all laundering costs. There also exist buttons, constructed of stronger material, but such buttons are more expensive, and the vast majority of garments contain traditional buttons. For the foreseeable future, the problem of buttons being lost and broken will exist, and there will be a need to identify and repair these buttons.

3. Description of Prior Art

There are a number of patent documents that relate to containers for holding small objects.

U.S. Pat. No. 2,920,670 (Jan. 12, 1960, Mohlmann) titled "Litter Bag," discloses a bag for collecting waste and containing articles. The bag comprises an envelope made of thin, semi-transparent waterproof plastic. The envelope includes reinforcing stitching, and a utility strap for securing the bag to objects, for carrying the bag, and for enclosing the opening of the envelope. Mohlmann, however, does not disclose an envelope adapted for use on a garment and for identifying button location.

U.S. Pat. No. 4,228,834 (Aug. 30, 1979, Desnick) titled "Soap Bag," discloses a bag for hand soap. The bag is stitched together from a strip of plastic mesh fabric having a hexagonal pattern. An opening in the bag has a flap with hook and loop fasteners for closing. A strap is attached to a loop segment of the bag for hanging. Desnick, however, is not adapted for use on a garment, and the strap is not used for a secure closure of the bag. Desnick is designed to be a combination washcloth and soap receptacle.

U.S. Pat. No. 4,418,733 (Dec. 6, 1983, Kallman) titled "Holding Device," discloses a multi-purpose holding device for use in moving vehicles. This holding device includes a pouch and a hook and loop fastener. The fastener is attached to a surface and then the pouch can be attached to the fastener. Kallman, however, is not adapted for use on a garment, and does not include a strap for securely enclosing a container. Kallman is designed to hold and insulate an open beverage container.

U.S. Pat. No. 4,789,262 (Dec. 6, 1988, Sanchez) titled "Soap Holding Cleaning Pad," discloses a soap holding cleaning pad apparatus. The apparatus has a nylon cloth sack and uses nylon mesh for a portion of a sack wall. A loofa plant fiber sponge forms a cleaning surface and is mounted over the nylon mesh. The sack has a cord handle, and an opening sealed with a hook and loop fastener. Sanchez, however, is not adapted for use on a garment, and for containing buttons. Instead, Sanchez is designed to provide a rapidly drying soap holder to prevent the growth of mildew.

U.S. Pat. No. 4,918,791 (Apr. 24, 1990, Hardin) titled "Clothing Button Guard," discloses a guard for enclosing buttons during a cleaning operation. The guard includes a cup-shaped container with a slot which allows the guard to slide over a button. A cap is secured to the container to completely enclose the button and protect it from damage. Hardin, however, is designed for use with attached buttons and does not disclose a method to secure and identify position of detached buttons.

U.S. Pat. No. 7,073,548 (Jul. 11, 2006, Berse-Hurley) titled "Pop-Up Purse," discloses a hand bag. The hand bag is assembled by folding a single piece of material. The single piece of material is folded to form walls, a bottom portion, and locking portions. The locking portions are engaged to hold the walls in position. The assembled hand bag can be collapsed for storage. Berse-Hurley, however, is not adapted for use on a garment, and for identifying a button repair location. Instead, Berse-Hurley is designed for carrying money, keys, credit cards, and photographs, and to be collapsed for storage.

U.S. Pat. No. 7,203,999 (Apr. 17, 2007, Bagot) titled "Button Protector For Laundering, Dry-Cleaning And Ironing Operations," discloses a flexible, detachable button protector. The protector has an enclosure that forms a cavity for surrounding a button. A slit in the side of the enclosure allows buttons to be inserted into the cavity. The protector shields buttons from corrosive laundering and dry-cleaning chemicals. Bagot, however, is designed for use with attached buttons and does not disclose a method to secure and identify position of detached buttons.

None of the above patent documents provides a method for (1) identifying and securing buttons for repair to a garment, (2) identifying a correct location on a garment for a button to be repaired, and (3) providing an individually brandable solution. What is needed, therefore, is a method and apparatus that overcomes the above-mentioned limitations and that includes the features enumerated above.

BRIEF SUMMARY OF THE INVENTION

The invention provides a method for holding and securing a button to a garment, and for identifying a location where the button should be reattached to the garment. The invention includes a button bag or container for holding fallen, loose, or spare buttons at a buttonhole of a garment.

The invention solves the problems identified above by providing a secure enclosure for a stray button, which enables a person to attach a detached button on a garment through a buttonhole corresponding to where the detached button needs to be sewn. In one embodiment, for use with decorative buttons, a button bag has a slit opening on a strap that can be used to attach the button bag to a location where there is no buttonhole, such as to a button adjacent to a missing button on a suit jacket sleeve. For detached decorative buttons without an adjacent button for attaching, the button bag can have an adhesive for adhering the bag to a garment in a correct location for repair.

Embodied with a slit on the button bag provides a location for a flared strap, passed through a buttonhole, to make a secure loop by inserting the strap through the slit on the button bag. Alternatively, the button bag can be fastened using a snap or hook and loop fastener. The button bag or container is preferably business-card sized with an integrated looping strap narrow enough to fit through a buttonhole, to attach the button bag or container to a garment at the appropriate repair location. The button bag or container can be made of printable cardstock, glassine, vinyl, or any other suitable material. Optionally, the button bag can be imprinted or branded by a dry cleaner or tailor to be used as a functional business card, encouraging return business.

In one embodiment, the button container includes a receptacle sized and designed to receive and securely contain a detached garment button. Preferably, the receptacle is sized to the approximate size of a business card, but the invention includes any type of receptacle sufficiently large to contain a garment button. A garment button can be any button used on apparel, for example, functional buttons on shirts and pants, decorative buttons on jackets and shoes, and so forth. A detached garment button is a button not sewn, or otherwise, fastened to a garment. A detached garment button can be an original button that has fallen, a replacement button for a lost button, or a broken button removed from a garment.

The receptacle is attachable to a garment at a location corresponding to a detached or broken button. That is, the receptacle is capable of being attached to a location indicating where a button needs to be repaired. For example, a buttonhole corresponds to a location where a button needs to be replaced. Also, a decorative button adjacent to a missing button, or a decorative button on an opposite sleeve of a missing button corresponds to where a button needs to be repaired. Attaching the receptacle to a garment in such a location thus physically indicates where a button needs to be repaired or replaced.

The receptacle can also include a looping strap designed to be looped through a buttonhole. Such a strap can also be secured to the receptacle. The receptacle can have a button strap slit for receiving the strap, a hook and loop fastener, or other device for securing a strap or string to the receptacle. Such a strap may also include a slit on the strap itself. This slit can be use to fit over an attached button on a garment. Such a slit is useful to attach the receptacle over a decorative button adjacent to a missing button, or over a broken button that needs to be replaced.

In another embodiment, the receptacle is capable of being attached to a garment at a location of a detached or broken button. To attach the receptacle to a location of a detached or broken button, the receptacle can have an adhesive, covered by a removable non-stick cover. A user would then remove the cover, similar to removing an adhesive cover on a mailing envelope or sticker, and then attach the receptacle directly on a garment approximately at a location of a missing button to physically identify where a button needs to be repaired.

Another embodiment includes a method of identifying a garment button for repair by providing or using such a button bag. Buttons for repair are identified by inserting a detached garment button into the receptacle, enclosing the receptacle, and attaching the receptacle to a garment at a location corresponding to a detached or broken button to indicate where a button needs to be repaired. The strap can also be secured to the receptacle after being looped through a buttonhole.

In all of the embodiments, such a button bag can be branded with identification of a service provider. For example, any of a company name, address, logo, colors, and so forth.

FEATURES AND ADVANTAGES

The button bag or button container can be used by consumers to hold stray buttons until such time as the consumer can bring a garment to a dry cleaner, launderer, or tailor for repair. A user can place the bag or container, containing the stray button, in a buttonhole at the exact location where the button is to be reattached. Alternatively, the bag can be constructed to enable consumers to place the bag or container at a location where a decorative or ornamental button has become detached and where there is no buttonhole in which to loop a strap of the button bag or button receptacle, such as on the sleeve of a men's suit coat.

By providing an easy way to attach a button container to a garment, consumers can feel certain that a stray button will not be lost before it can be reattached to the garment.

The bag, receptacle, or envelope can be constructed of various materials, such as paper, cardstock, glassine, vinyl, or other materials. This enables a button bag of the invention to be manufactured at a various prices. The bag can be constructed of printable material. Using a printable material enables a dry cleaner, tailor, launderer, or hospitality facility to brand the button bag with its name, logo, address, etc., which serves as a functional business card reminding consumers where garments can be brought for repair, and thereby encouraging return business.

The button bag can be constructed from a single piece of material and manufactured in high volumes. Providing an economical means of production and manufacture makes the invention an attractive investment to the dry cleaning, laundry, tailoring, and hospitality industries.

The button bag can be constructed the size of a typical business card, and can be distributed by service suppliers at a point of purchase. A consumer could then carry the button bag in his or her wallet or purse to be used in the event that a button falls off during the course of the day, when the consumer is away from home. Service providers can also easily distribute branded button bags by direct mail.

The invention is ideal for use with express drop-off cleaning, tailoring, and hotel services, or where the consumer may not have face-to-face contact with the dry cleaning, laundry, or tailoring staff to deliver instructions about a button needing repair.

BRIEF DESCRIPTION OF THE DRAWINGS

FIG. 3 is a front view of an assembled button bag with a strap looped and inserted into a body of the button bag.

FIG. 4 is a rear view of an assembled button bag with a strap looped and inserted into a body of the button bag.

DETAILED DESCRIPTION OF THE INVENTION, INCLUDING THE PREFERRED EMBODIMENT

Operation

In the following detailed description of the invention, reference is made to the accompanying drawings which form a part hereof, and in which are shown, by way of illustration, specific embodiments in which the invention may be practiced. It is to be understood that other embodiments may be used, and structural changes may be made without departing from the scope of the present invention.

Figure 1:
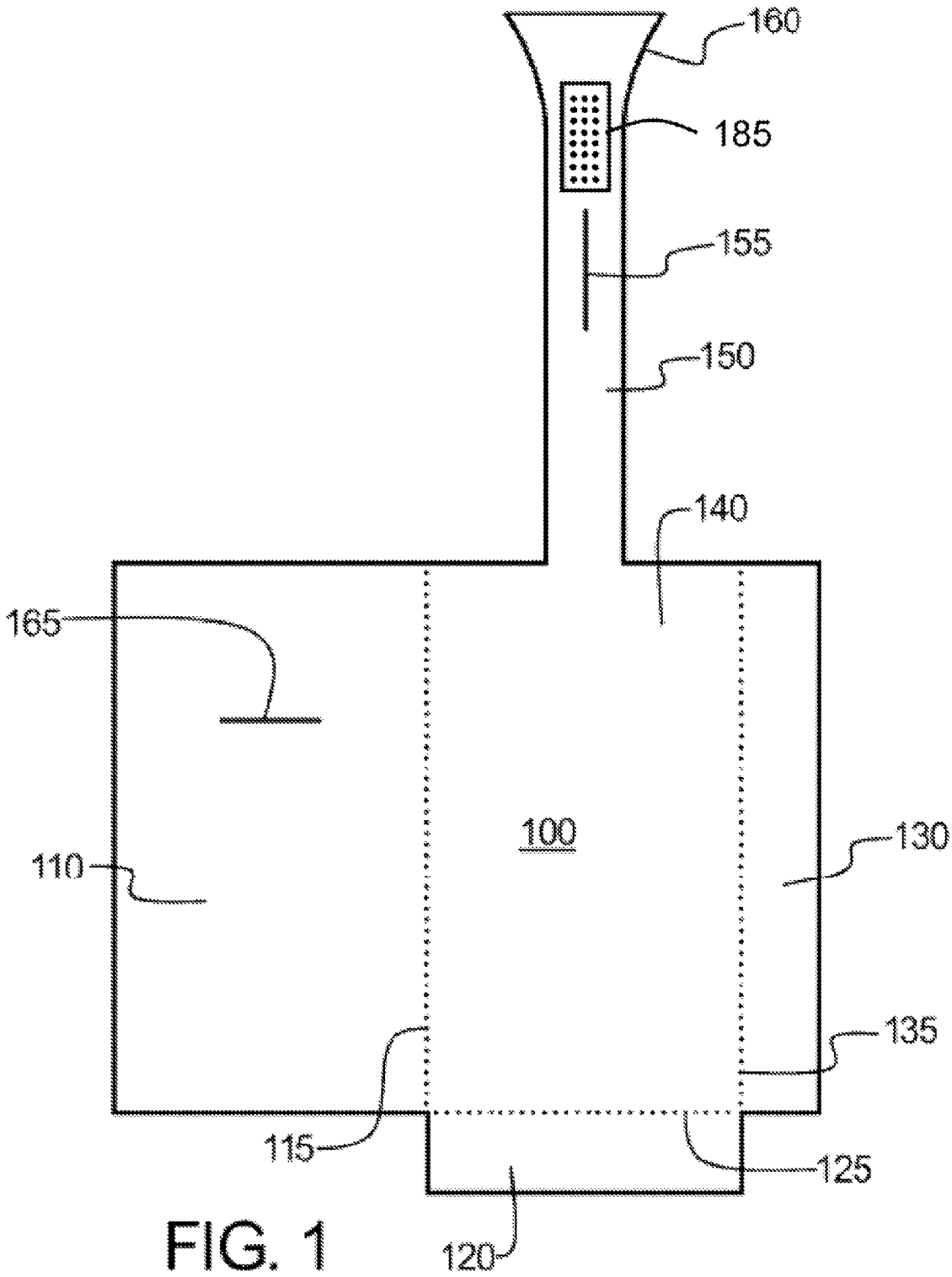
FIG. 1 is a drawing of a button bag pattern.

Referring to FIG. 1, button bag pattern 100 consists of four panels 110, 120, 130, and 140, and strap 150. Preferably, button bag pattern 100 is die cut from a single piece of material. Strap 150 extends from the center of panel 140. Strap 150 contains button slit 155 and strap end 160 which is preferably flared. Button slit 155 is an opening that can be used to attach to an existing button—a button that is attached to a garment. Strap end 160 can optionally be circular, or have side extensions, such that strap end 160 is wider than a width of strap 150. Strap end 160 can have side extensions and taper to a point for easier insertion into a slit. Strap 150 has a width that is preferably sized to fit through typical buttonholes. Button bag pattern 100 has three fold lines 115, 125, and 135, and strap end slit 165 located at an upper portion of panel 110.

Figure 2:
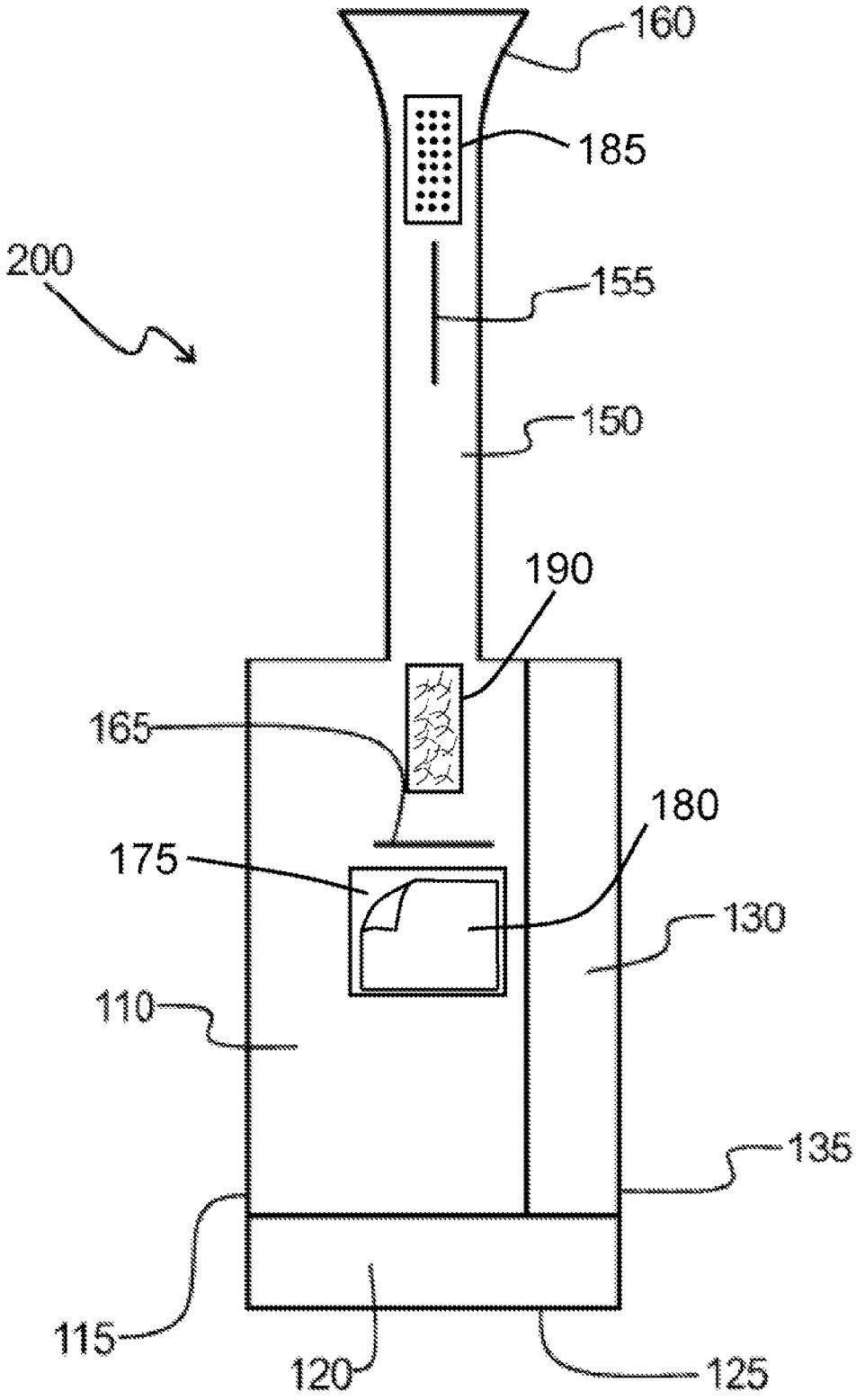
FIG. 2 is a rear view of an assembled button bag.

Referring to FIG. 2, button bag 200 is formed by inwardly folding panels 110, 120, and 130 toward panel 140 along fold lines 115, 125, and 135. Panels are then sealed together with an adhesive or other fastener to form button bag 200.

Referring to FIG. 3, button bag 200 is used by inserting a button into button bag 200. Then strap 150 is inserted through a buttonhole (not shown) and secured to button bag 200 by inserting strap end 160 into strap end slit 165, thereby forming a loop. Strap end slit 165 is sized to receive and secure strap 150, wherein button bag 200 is securely attached to a garment for subsequent removal by a person. FIG. 4 depicts button bag 200 showing outer side 170 of panel 140, and with strap 150 forming a loop. Panel 170 is preferably used for printing the name of a business or service provider.

Figure 5:
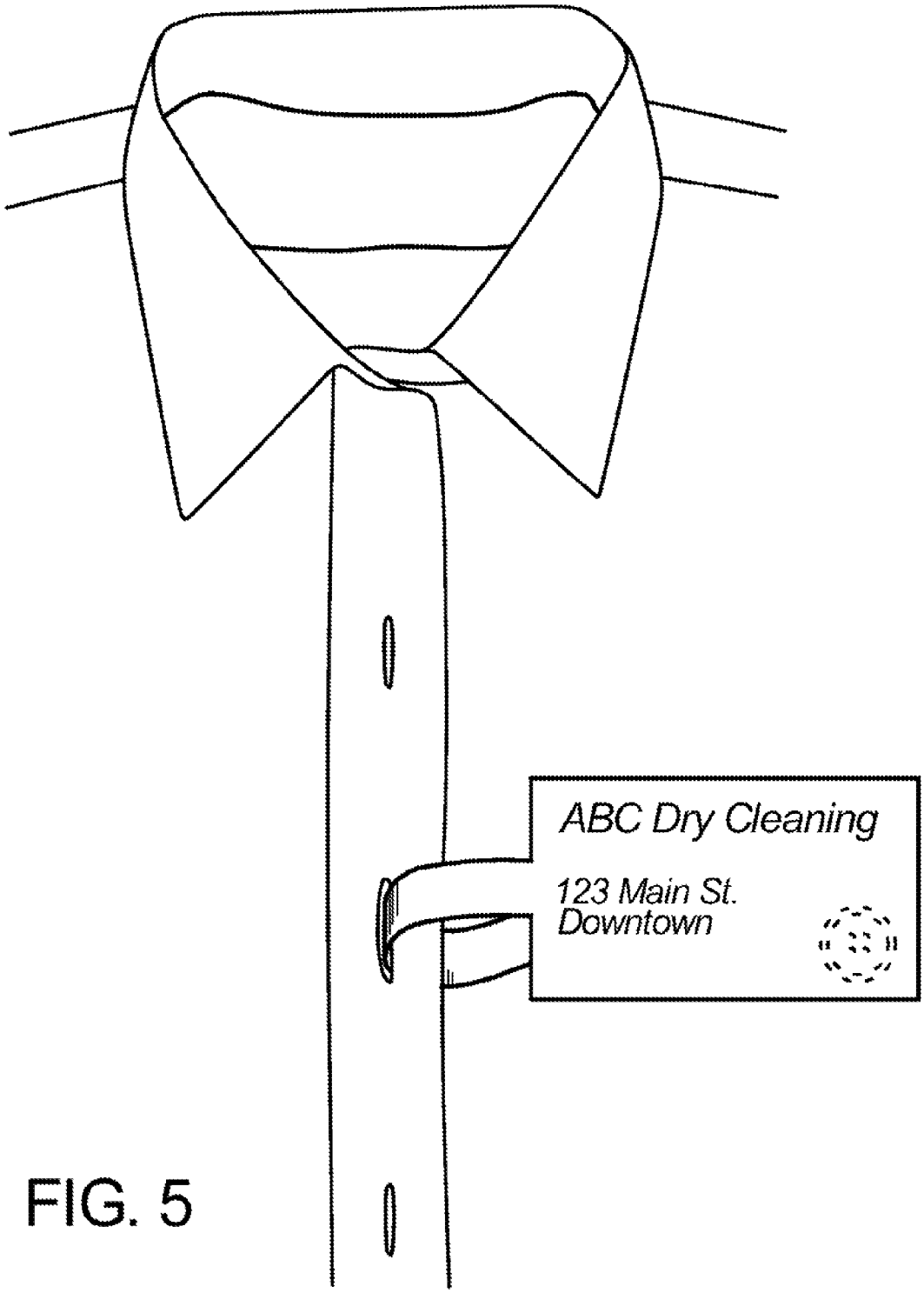
FIG. 5 is an illustration of a button bag attached to a shirt indicating a repair location.

FIG. 5 depicts use of button bag 200 on a shirt. Button bag 200 contains a button, and is securely attached through a buttonhole on the shirt, thereby identifying a location where the button is to be reattached.

Other Embodiments

As can be perceived by combined reference to FIGS. 1 and 2, for example, the button bag 200 can have a hook 185 and loop 190 fastener for permitting the strap 150 to be secured to the receptacle portion of the button bag 200. Additionally or alternatively, for attaching the button bag 200 to a location of a detached or broken button, the button bag 200 can have an adhesive 175, which can be covered by a removable non-stick cover 180. In practice, the non-stick cover 180 could be removed from the adhesive 175 to permit a direct attachment of the button bag 200 to a garment at, for example, a location of a missing button to identify where a button needs to be repaired or replaced.

It is to be understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

The invention claimed is:

1. A method of identifying where a button on a garment needs to be repaired the method comprising:

providing a receptacle sized and designed to receive and securely contain a detached garment;

providing means for attaching the receptacle to a garment at a location corresponding to a detached or broken button thereby indicating where a button needs to be repaired wherein the means for attaching the receptacle to a garment comprises a looping strap with a proximal end fixed to the receptacle, a body portion for being looped through a buttonhole, and a distal end in combination with means for securing the distal end of the looping strap to the receptacle to form a loop wherein the body portion of the looping strap is sized to be received through a buttonhole; and attaching the receptacle to the garment in a location indicative of where a button on the garment needs to be repaired.

2. The method of claim 1, further comprising branding the receptacle with identification of a service provider.

3. The method of claim 1 further comprising providing a means for retaining the button container relative to a button, the means for retaining the button container relative to a button comprising a button slit in the body portion of the looping strap, wherein the button slit designed to fasten to a button attached to a garment, thereby attaching the receptacle to a garment and attaching the button container to a button by inserting the button through the button slit.

4. The method of claim 1 further comprising providing a means for adhering the button container to a garment at a location indicating where a button needs to be repaired, the means for adhering the button container to a garment comprising an adhesive on the button container and a removable cover for covering the adhesive, removing the cover from the adhesive, and adhering the button container to the garment by use of the adhesive.

5. The method of claim 1 wherein the means for securing the distal end of the looping trap to the receptacle comprises a hook and loop fastener.

6. A method of identifying a garment button for repair, the method comprising:

providing a receptacle sized and designed to receive and securely contain a detached garment button;

inserting a detached garment button into the receptacle;

enclosing the receptacle;

providing means for attaching the receptacle to a garment at a location corresponding to a detached or broken button thereby indicating where a button needs to be repaired wherein the means for attaching the receptacle to a garment comprises a looping strap with a proximal end fixed to the receptacle, a body portion for being looped through a buttonhole, and a distal end in combination with means for securing the distal end of the looping strap to the receptacle to form a loop wherein the body portion of the looping strap is sized to be received through a buttonhole;

attaching the receptacle to a garment at a location corresponding to a detached or broken button, thereby indicating where a button needs to be repaired.

7. The method of claim 6 wherein attaching the receptacle to a garment at a location corresponding to a detached or broken button includes looping the looping strap through a buttonhole of a garment and securing the distal end of the looping strap to the receptacle to form a loop.

8. The method of claim 6 further comprising providing a means for adhering the button container to a garment at a location indicating where a button needs to be repaired, the means for adhering the button container to a garment comprising an adhesive on the button container and a removable cover for covering the adhesive, removing the cover from the adhesive, and adhering the receptacle to a garment by use of the adhesive.

9. The method of claim 6 further comprising providing a means for retaining the button container relative to a button, the means for retaining the button container relative to a button comprising a button slit in the body portion of the looping strap, wherein the button slit designed to fasten to a button attached to a garment, thereby attaching the receptacle to a garment and attaching the button container to a button by inserting the button through the button slit.

* * * * *